US005196643A

United States Patent [19]

Jörg et al.

[11] Patent Number: 5,196,643

[45] Date of Patent: Mar. 23, 1993

[54] APPARATUS FOR LOADING TUBULAR WEAPONS, PARTICULARLY TANK HOWITZERS

[75] Inventors: Josef Jörg, Augsburg; Rudolf Bobinger, Nordendorf; Wolfgang Eyb, Leonberg, all of Fed. Rep. of Germany

[73] Assignee: KUKA Wehrtechnik GmbH, Augsburg, Fed. Rep. of Germany

[21] Appl. No.: 679,941

[22] Filed: Apr. 3, 1991

[30] Foreign Application Priority Data

Apr. 4, 1990 [DE] Fed. Rep. of Germany ..... 4010845

[51] Int. Cl.[5] ..... F41A 9/43

[52] U.S. Cl. ..... 89/46; 89/47

[58] Field of Search ..... 89/45, 46, 47, 33.05

[56] References Cited

U.S. PATENT DOCUMENTS

| | | | |
|---|---|---|---|
| 1,753,850 | 4/1930 | De Courseulles | 89/47 |
| 2,849,924 | 9/1958 | Nutting et al. | 89/47 |
| 2,971,439 | 2/1961 | Ebersole, Jr. et al. | 89/47 |
| 3,884,119 | 5/1975 | Zouck | 89/45 |
| 4,481,862 | 11/1984 | Wiethoff et al. | 89/46 |

FOREIGN PATENT DOCUMENTS

| | | | |
|---|---|---|---|
| 256250 | 8/1990 | European Pat. Off. . | |
| 3627261 | 2/1988 | Fed. Rep. of Germany | 89/46 |
| 5889 | of 1908 | United Kingdom | 89/47 |
| 12958 | of 1908 | United Kingdom | 89/47 |

*Primary Examiner*—Stephen M. Johnson

*Attorney, Agent, or Firm*—Antonelli, Terry, Stout & Kraus

[57] ABSTRACT

An apparatus for loading tubular weapons with a propellant charge chamber comprises a loading arm pivotably mounted on the pivot bearing of the barrel and having a loading tray for a shell and a rammer engaging on the shell bottom and having a drive, the shell being brought by means of the loading arm into a starting position aligned with the barrel bore axis and transported by means of the rammer into the barrel, into whose rifling it is rammed. In order to allow a completely satisfactory ramming, the loading tray can be moved in a guide on the loading arm between the starting position and a support position centered on the barrel and that the rammer has a support retracted in the starting position and engaging on the shell bottom and which can be brought into a stretched position synchronously with the movement of the loading tray into the support position and in said stretched position can be moved in a guide by means of the drive relative to the loading tray and while accelerating the shell into the barrel.

14 Claims, 7 Drawing Sheets

APPARATUS FOR LOADING TUBULAR WEAPONS, PARTICULARLY TANK HOWITZERS

FIELD OF THE INVENTION

The invention relates to an apparatus for loading tubular or barrel weapons, particularly armored or tank howitzers, with a propellant charge chamber, comprising a loading arm pivotably mounted on a pivot bearing of the barrel and having a loading tray for a shell and a rammer engaging a bottom of the shell, with the rammer having a drive, and with the shell being brought by the loading arm and loading tray into a starting position aligned with the bore axis of the barrel, and being transported into the barrel by the rammer and rammed into the rifling thereof.

BACKGROUND OF THE INVENTION

An apparatus having the above construction as proposed in, for example, EP-A-256 250, wherein vertically standing shells in a bottom magazine or removed from the magazine by a gripper and directly delivered to an indexing position of the barrel. For this purpose, the gripper is pivotable on the loading arm about a further axis substantially perpendicular to the pivot axis. Thus, when the loading arm is pivoted outwardly, the gripper can be pivoted outwardly and receiving a shell in a reception position on the magazine. After pivoting the gripper into its starting position, the loading arm is pivoted upwardly until a shell, resting on a loading tray, is aligned with the bore axis of the barrel. The shell is transported from this starting position, by the rammer, into the barrel.

In the starting position, the shell is at a considerable distance from its final position in the barrel. In the above proposed construction, this distance must be bridged by the rammer. With two-part ammunition, in which the shell and the propellant charge are introduced separately into the barrel, the shell must be rammed into the barrel rifling. For this purpose it is provided, on its outside and near to the bottom, with a ring made from soft deformable material, which is sealingly rammed into the barrel rifling end, for this purpose, considerable accelerative forces must be applied. As the loading tray can only bring the shell to the bottom of the barrel, so that in free flight the shell must be transported by the bottom piece and the propellant charge chamber, it is hardly possible to bring about a completely satisfactory ramming from the starting position. Ramming is even more difficult in that the propellant charge chamber is rearwardly constricted by a bottom ring, which projects in a vicinity of a lower tip of the chamber into the free cross-section thereof and has the function of supporting the introduced propellant charge with an elevated barrel. This bottom ring forms a "trip edge" for the shell and, in particular, for the ring thereon which is used for ramming. Consequently, a tilting of the shell occurs.

SUMMARY OF THE INVENTION

The aim underlying the present invention essentially resides in providing an apparatus which permits a completely satisfactory ramming of the shell into the barrel rifling.

In accordance with advantageous features of the present invention, the loading tray is movable in a guide on the loading arm between the starting position and a support position centered on or with respect to a bore axis of the barrel, and the rammer has a support, recoiled into the starting position and engaging the bottom of the shell, which can be brought into a stretched position synchronously with the movement of the loading tray into the support position and, in the stretched position, is displaceable in a guide by the drive relative to the fixed loading tray, accompanying by the acceleration of the shell into the barrel.

By virtue of the features of the present invention, the shell, resting on the loading tray, is brought up to the barrel by the loading tray and the shell tip, projecting over the tray, can project into the barrel. On moving the loading tray, the support engaging on the shell bottom as a rammer is brought from a recoiled position synchronously into the stretch position, result in the loading tray reaching the support position. From the support position, the support then acts as a rammer, in that it passes on in the guide and by the driver accelerates the shell into the barrel. This bridges the relatively large gap between the starting position and the final position of the shell in the barrel. In addition, the support, acting as a rammer, only comes into action in the support position from which the shell is accelerated. After leaving the loading tray, the shell moves over a short distance freely in the barrel until it is rammed into the rifling of the barrel. Following the loading process, the support travels back with the loading tray into the starting position.

Preferably, the support is coupled by drivers to the loading tray, as a result of the movement thereof, can be raised into the stretched position, so that only one drive is required for raising the support and for moving the tray.

According to further features of the present invention, the rammer driver comprises at least one motor-pretensioned spring, a simple gearing for converting a deflection of the spring into a rotary movement and a chain drive coupled to the gear and acting on the support in the stretched position.

Advantageously, the spring drive provides relatively large forces that can be released suddenly, so that the shell is given an adequate acceleration.

Preferably, the gear comprises a rack, a fixed pinion meshing therewith and a pulley, located on a spindle of the pinion, for driving a chain wheel of the chain drive.

An advantage of the drive with the gear and chain drive resides in the fact that, under the always constricted space conditions, it is possible to increase the spring deflection in a simple manner. For example, the spring deflection can be geared to at least 1:2 and, preferably, to more than 1:3 by the gear and chain drive. This can be achieved in the simplest form in that the spring deflection is geared by different diameters of the pinion and pulley connected thereto.

Accordingly to still further advantageous features of the present invention, the rack is connected to one end of the spring and the pinion is mounted in a fixed manner on the loading arm and, at the other end of the spring, engages the drive thereby tensioning the same in the case of a fixed rack. Thus, the bias of the spring is directly transferred to the rack.

The chain drive of the present invention is guided by the driving chain wheel, in each case one chain wheel located at each end of the loading tray on one side of the support and by the driving chain wheel via at least one chain wheel fitted to the loading arm on the other side of the support, and is fixed by its ends to the support, with the fixed points being located at positions not influenced during the stretching movement of the support.

According to the invention, the support is formed by a leverbar, which can be brought from a flat, folded position in the starting position into a stable stretched position in the support position.

The construction can, in particular, be such that the leverbar comprises two successively connected parallelogram links, whose successive guide rods, in each case, form an articulated lever, articulated at one end to a base forming the foot of the support and at an opposite end on a coupler forming a thrust piece engaging on the shell bottom. The articulated joint of one articulated lever may be bridged by a joint brace, whose joint runs in a guide extending between the articulated levers on which is positioned the joint of the other articulated lever.

The aforementioned construction makes it possible to recoil the leverbar in the smallest possible space, and conversely, with minimum space requirements to achieve a maximum stretched or extended length.

The stability of the support for accelerating the shell can be further improved in that at least one of the articulated levers moves in an over-dead center position, which is ensured by an additional spring.

The folding of the leverbar can be assisted in that the leverbar is associated with a stop mechanism, which bends the leverbar to the side on recoil.

In order that the support can perform the ramming movement in the stretched position, according to a further development, the loading tray is provided with a longitudinal slot in a vicinity of its lower tip and, in the slot, runs a guide slide located on the support after reaching the support position during the ramming movement.

According to the present invention, a release mechanism engages on the base of the leverbar forming the support, which blocks the latter during the raising of the leverbar from the folded into the stretched position and simultaneously blocks the gear by the chain and, consequently, fixes the spring end connected to the rack, which is pretensioned by the drive during the raising of the leverbar. The release mechanism releases the stretched support and, therefore, the chain, so that the bias of the spring acts, via the gear end of the chain, on the support and the latter accelerates the shell into the ramming position.

In order to be able to move shell on the loading traY up to or into the barrel, the tray is centered in the support position in the vicinity of the barrel bottom.

If, as noted above, the propellant charge chamber of the barrel weapon has a bottom ring, then, preferably, the loading tray is centered on the ring, i.e. the loading tray is introduced into the bottom piece of the barrel, is centered on the bottom ring and only then does the support perform its ramming movement.

Thus, the shell, which already projects into the barrel bottom piece in the support position, can be accelerated without impediment from the loading tray over the bottom ring and can be rammed into the rifling.

Advantageously, the bottom ring has a depression and the loading tray a centering projection engaging in the latter which is optionally spring cushioned.

While it is easily possible to bring about the return motion of the loading tray by a reversal in a direction of rotation of its drive, by the drive for biasing the spring and which, via the relaxed spring, carries with it the rack, and via the gear the chain drive, the support can be returned from the ramming position, via the support position into the starting position and, upon reaching the latter, the loading tray acts on the stop mechanism initiating the folding movement of the leverbar.

BRIEF DESCRIPTION OF THE DRAWINGS

The invention is described in greater detail hereinafter relative to a non-limitative embodiment and the attached drawings, wherein.

DETAILED DESCRIPTION

Figure 1:
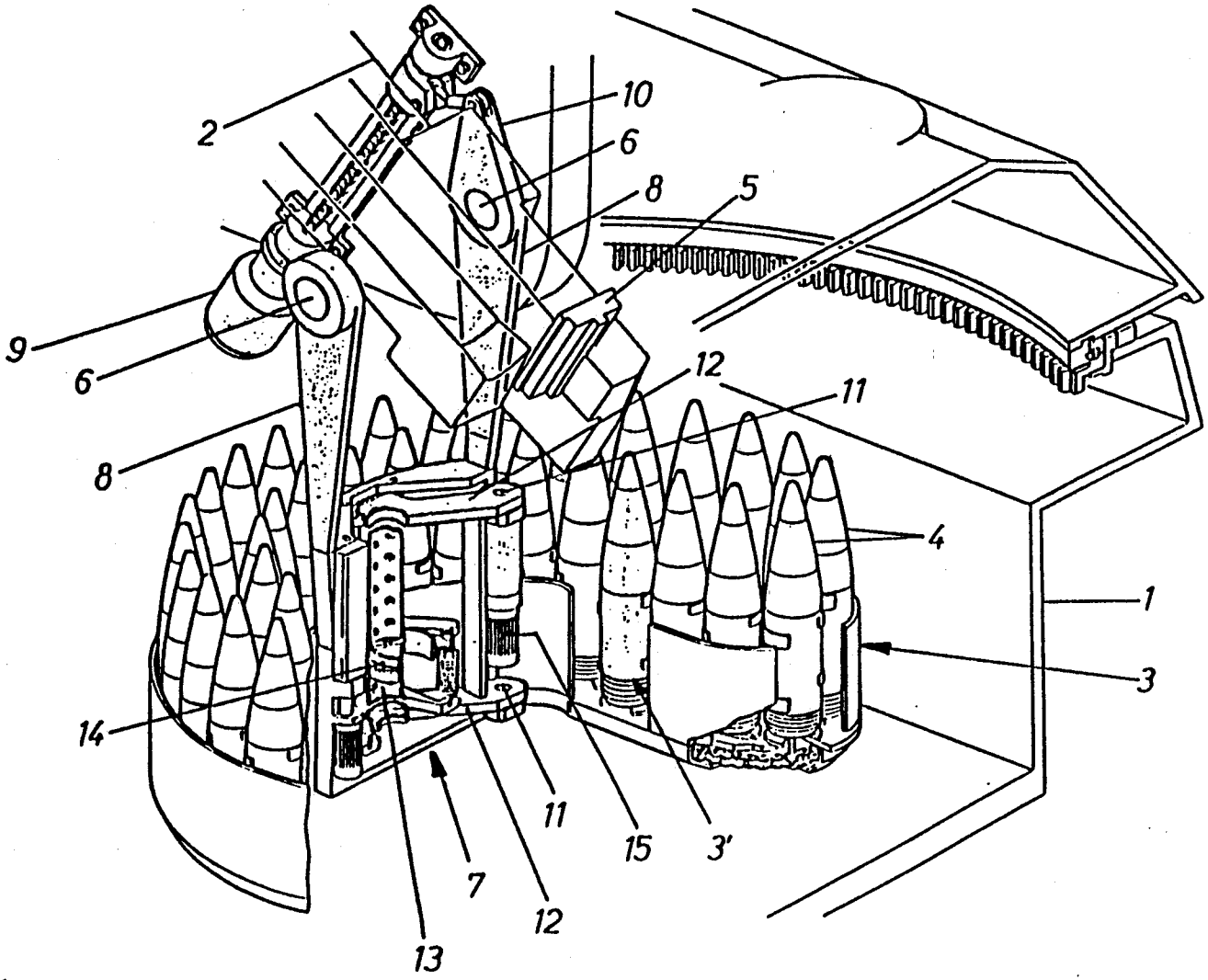
FIG. 1 is a partial perspective view of a tank turret with the loading means in a basic position.

Referring now to the drawings wherein like reference numerals are used throughout the various views to designate like parts and, more particularly, to FIG. 1, according to this figure, a tank turret 1 includes a barrel 2, with a part ring-shaped magazine 3 being provided on the bottom of the turret 1, and with the magazine having shells 4 standing therein. The shells 4 are transported in a loop by a chain drive or the like on the part ring-like path, with the magazine 3 having a transfer position 3'.

The magazine 3 is positioned below the barrel 2 in the vicinity of the bottom thereof, together with the breech block 5. In the drawing, the barrel 2 is in a positive indexing position. The barrel 2 can be moved about the horizontal pivot pin 6 into the indexing position.

The barrel 2 is loaded by an apparatus 7, which has a loading arm 8 with two levers. The loading arm 8 is suspended on swivel bearings on the barrel 2 and the axis thereof corresponds with the pivot pin or axis 6 of the barrel 2. With the loading arm is associated with a swivel drive 9 fixed to the tank turret and which engages on an extension 10, extending beyond the pivot pin 6 of the lever of the loading arm 8.

Figure 2:
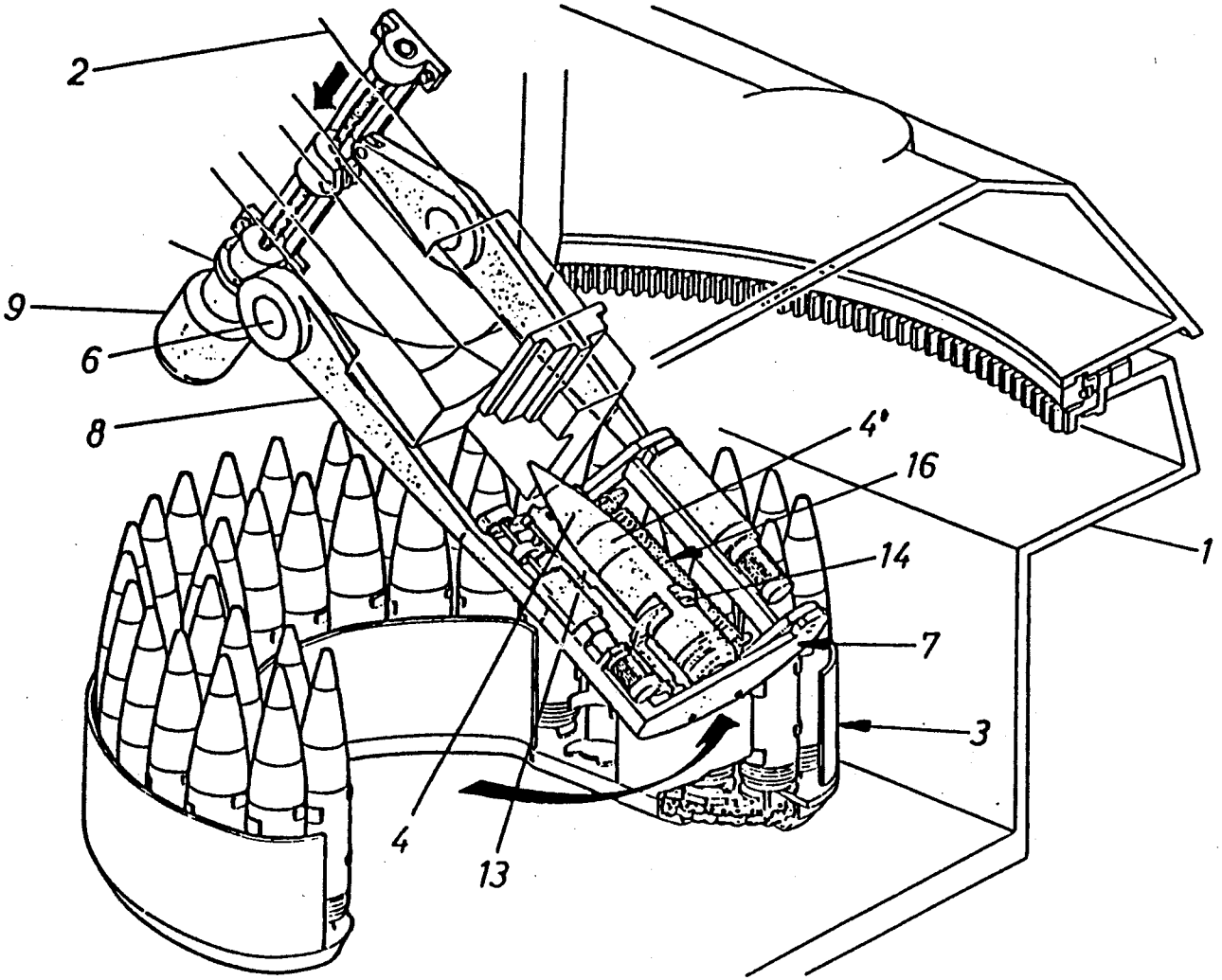
FIG. 2 is a perspective view of the loading means corresponding to FIG. 1 in the starting position on loading.

At least one gripper 14 is mounted on the loading arm 8 on a vertical spindle 11 via arms 12. The gripper 14 can be pivoted by the arms 12 about the vertical spindle 11 up to the shell 4 located in the transfer position 3', in which the shell 4 is taken over by the gripper 14. The rotary drive 15 is provided for pivoting the gripper. On the loading 8 is also provided a loading tray 13, in which is inserted the shell 4 following the pivoting back of the gripper 14. Following the taking over of the shell 4, the loading arm 8 is pivoted by the swivel drive 9 about the pivot pin 6 into the indexing position of the barrel 2, where the shell 4 reaches the starting position 4' for loading (FIG. 2).

Figure 3:
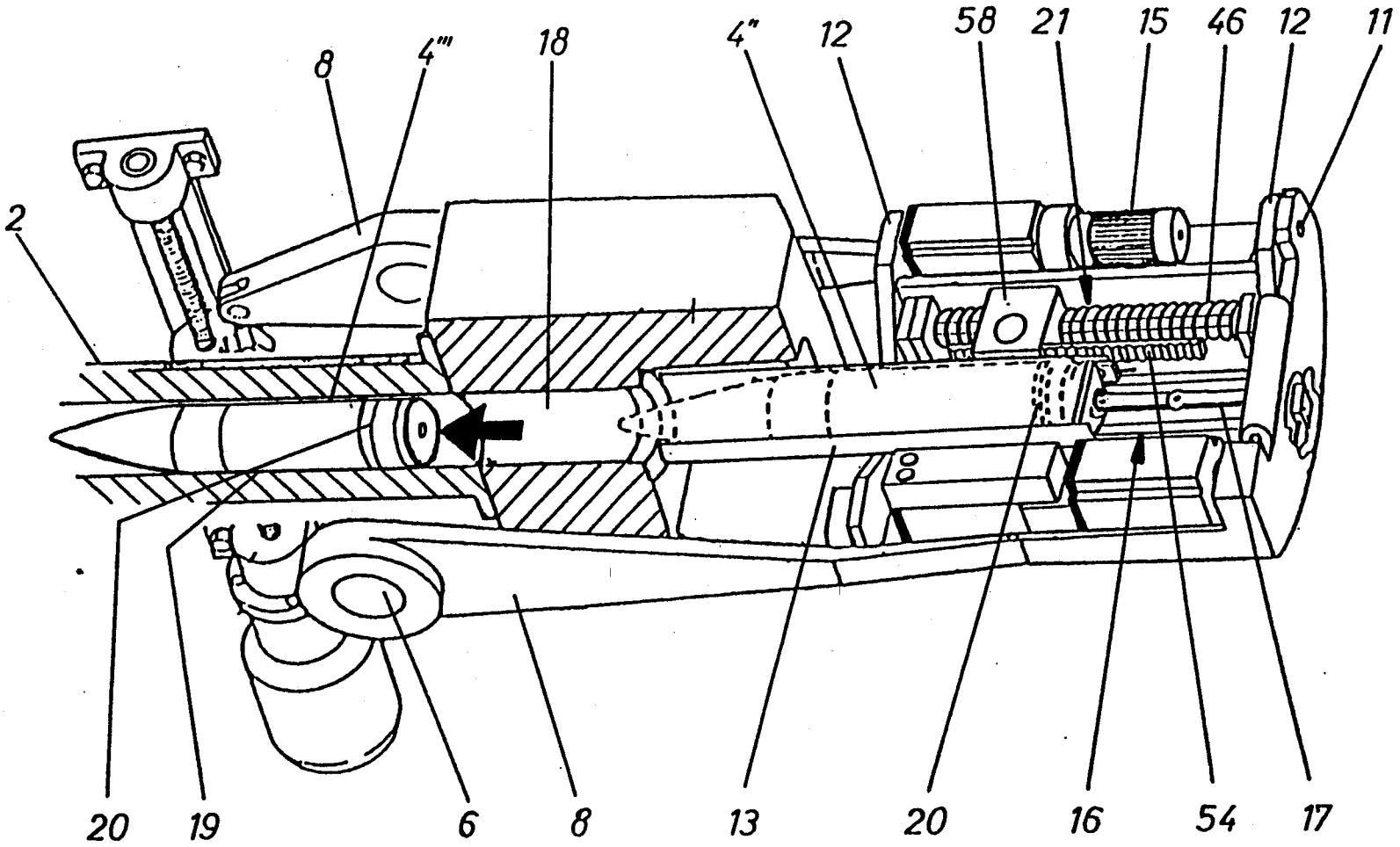
FIG. 3 is a partial cross-sectional perspective view of the loading means according to FIG. 2 in the support position.

A rammer 16 is used for loading and has a recoilable support 17 (FIG. 3), with the support 17 engaging the bottom of the shell 4. The loading tray 13 is also movably guided on the loading arm 8, so that the shell 4 can be brought from the starting position 4', shown in FIG. 2, into the support position 4" by the loading tray 13. During this movement, the support 17, engaging on the shell bottom, is brought into a stable stretched position, as shown in FIG. 3. From this position, the shell 4 is accelerated into the barrel 2 by the support 17 in the stretched position until in position 4''' upstream of the propellant charge chamber 18, and the shell 4 is rammed into the rifling 19 of the barrel 2 by its externally arranged ring 20. This ramming process is brought about a drive 21 described more fully hereinbelow in connection with FIGS. 5 and 7.

Figure 4:
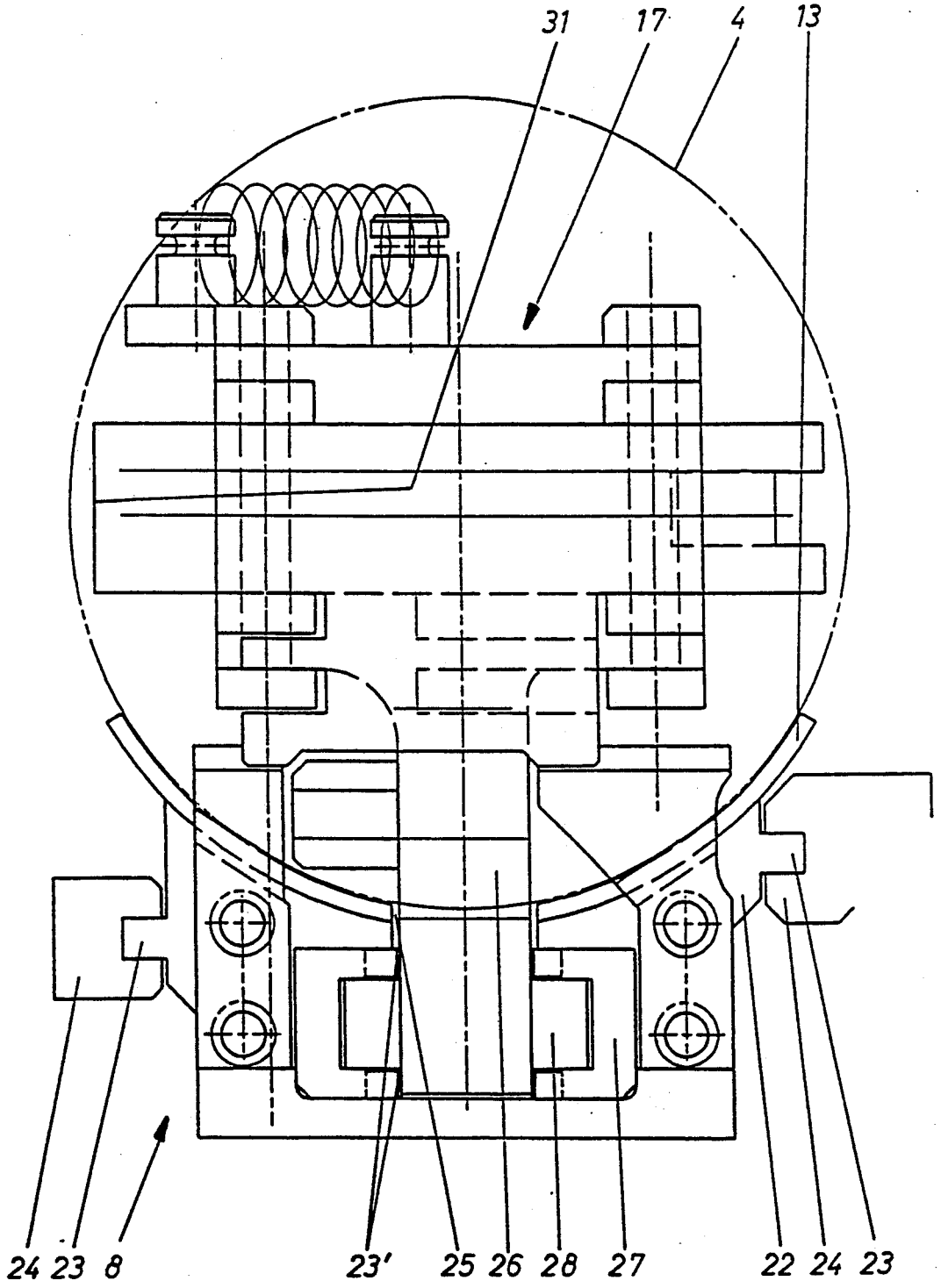
FIG. 4 is a schematic plan view of the support and the loading tray from the area thereof.

The loading tray 13 has a base 22 which laterally projecting guide rails 23 (FIG. 4) by which it can be moved in flat guides 24 on the loading arm 8. In the vicinity of its lower tip and, at least in its rear region, the loading tray 13 has an open longitudinal slot 25, in which runs a downwardly projecting guide slot 26 on the support 17, in order to be able to perform the ramming movement from the support position 4" (FIG. 3). The guide slide 26 of the support 17 runs with sliding pieces 28 in a fixed guide rail 27 and, in the further course of movement in guides 23' on the base of the loading tray 13. The guide rail engages in the loading tray base 22, so that the support 17, in the stretched position, is guided in a completely satisfactory manner during the ramming movement on the loading arm and/or on the loading tray.

Figure 5:
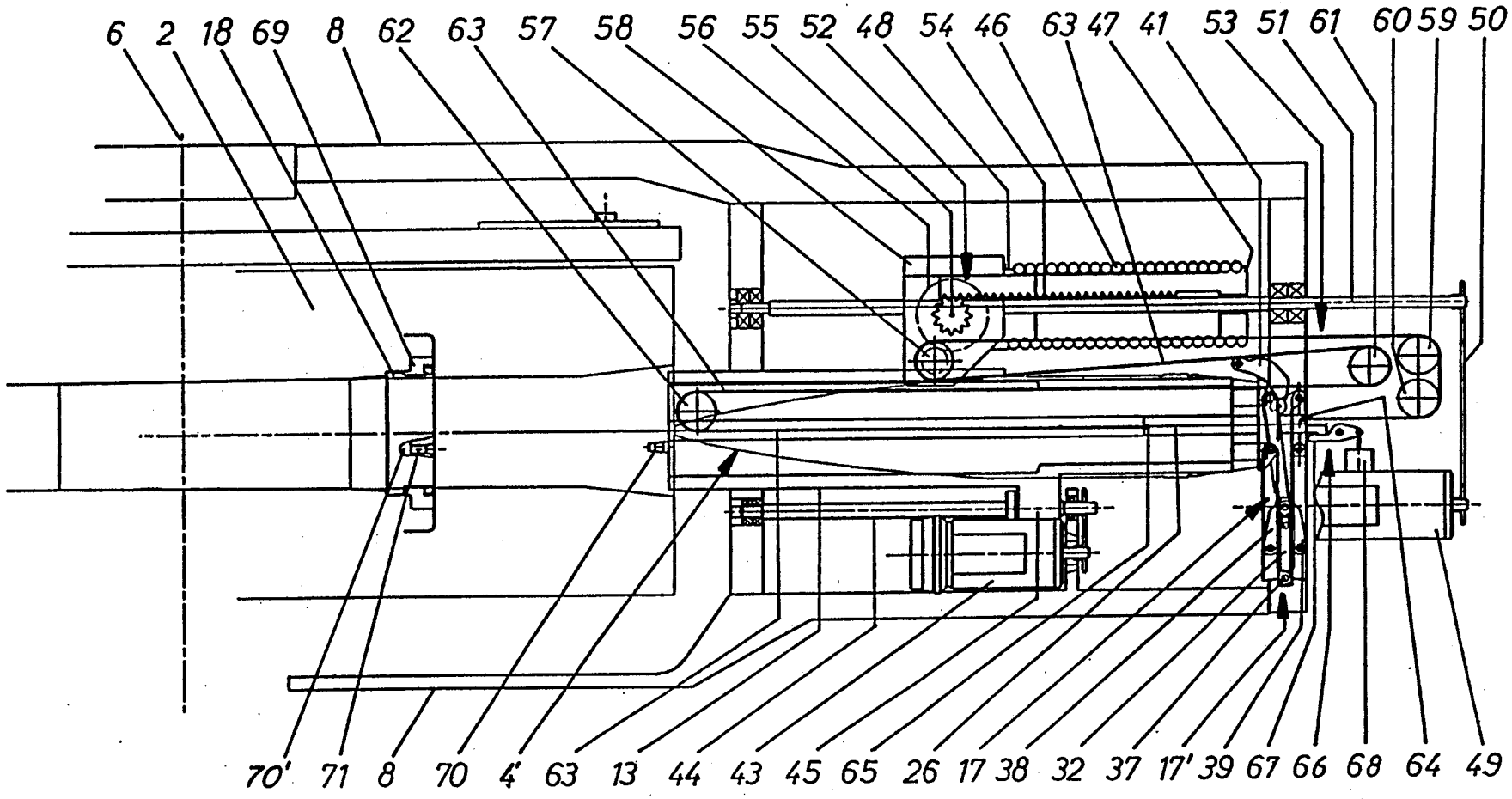
FIG. 5 is a schematic plan view of the loading arm in the starting position.
Figure 6:
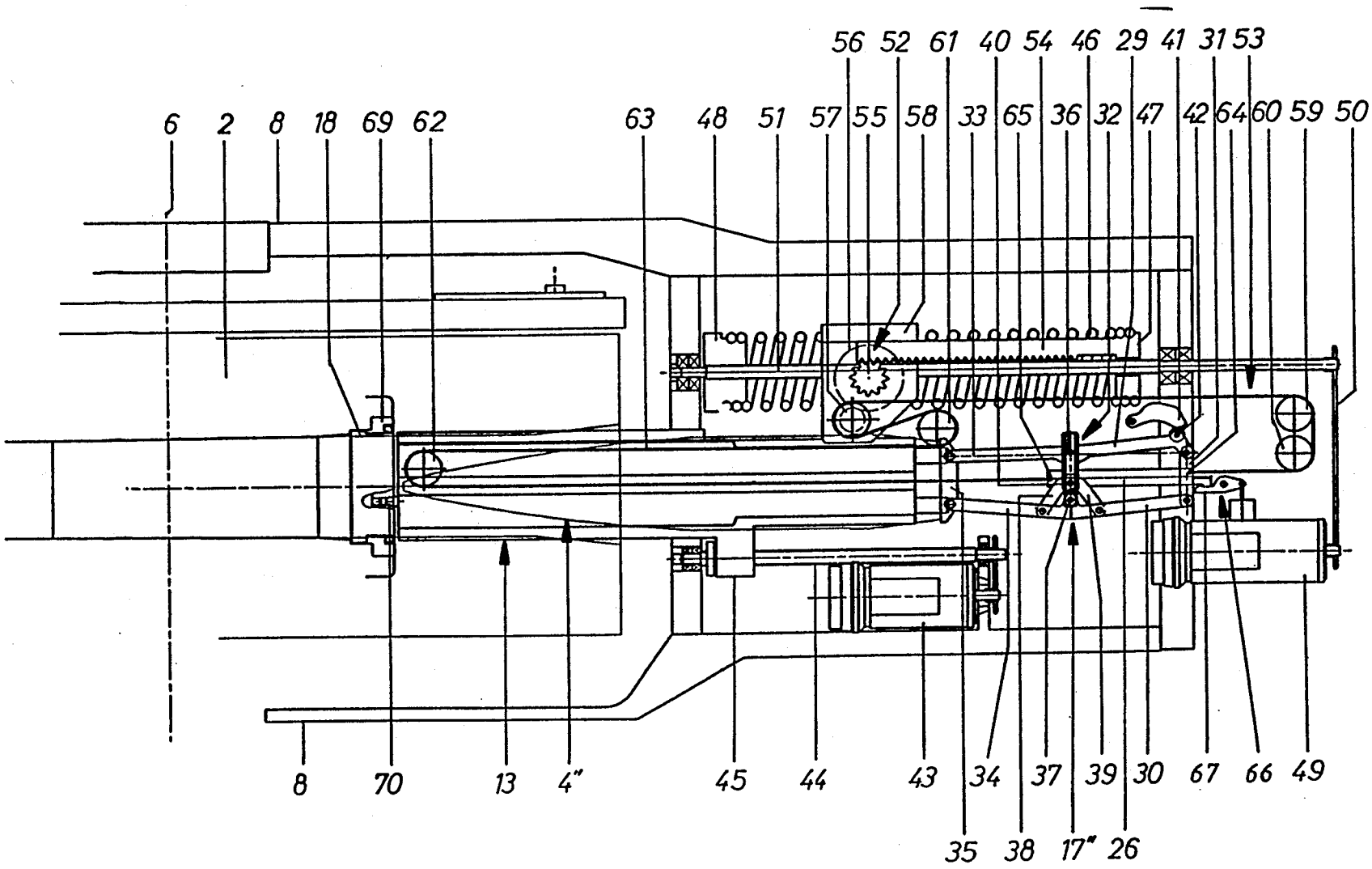
FIG. 6 is a schematic plan view corresponding to FIG. 5 in a support position.
Figure 7:
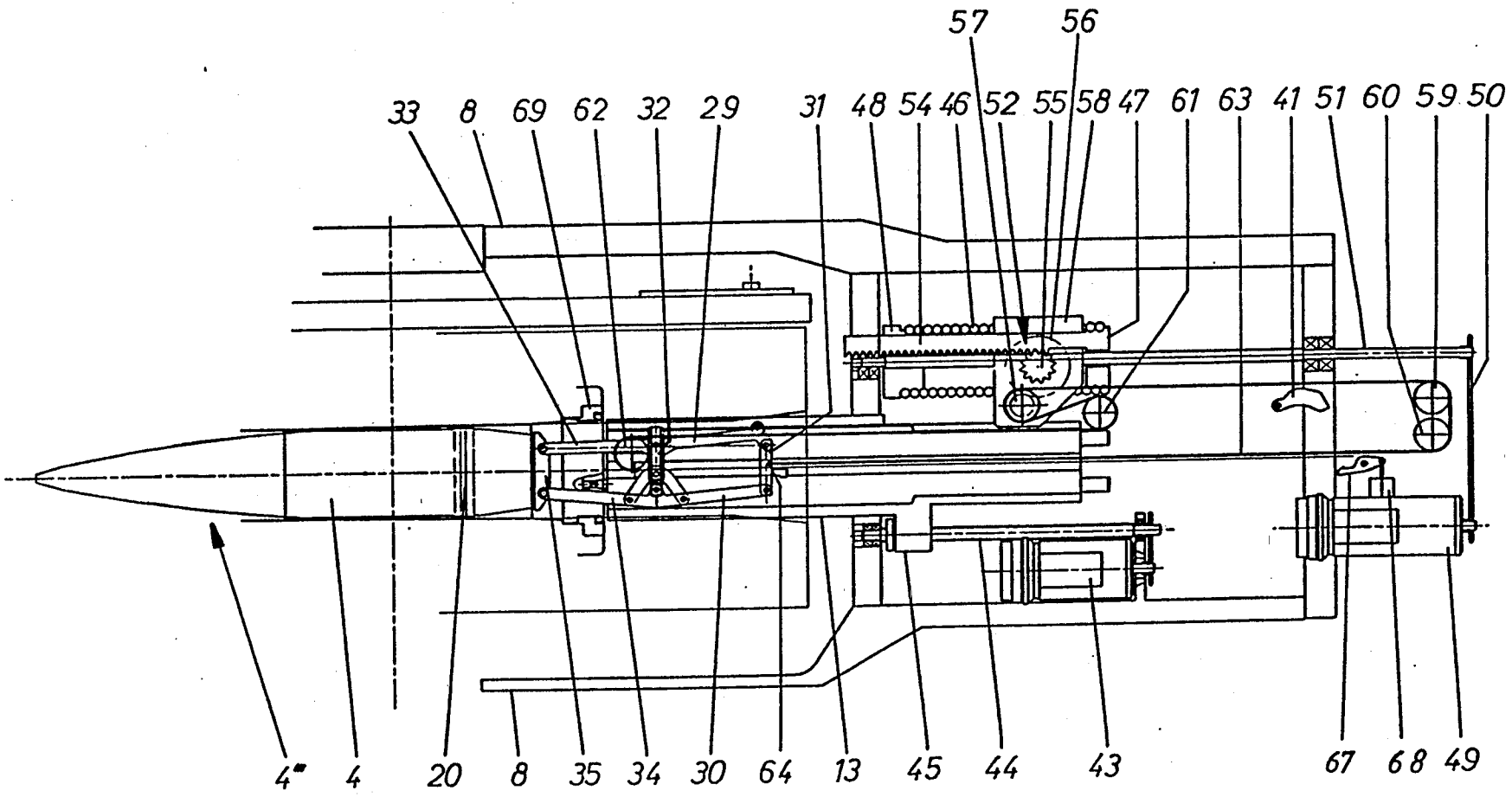
FIG. 7 is a schematic plan view corresponding to FIG. 5, on a somewhat reduced scale, with a rammed shell.

In FIG. 3, the support 17 is diagrammatically represented by a simple articulated bar. However, in fact, the support 17 comprises a multimember leverbar shown in greater detail in FIGS. 5 to 7. In FIG. 5, the recoiled or retracted position of the leverbar at the end of the stroke or lift arm is designated by the reference numeral 17'. This position corresponds to the starting position shown in FIG. 2, while, in FIG. 6, the reference numeral 17" designates the stretched position, which is assumed by the leverbar in the support position 4" of the shell according to FIG. 3. The leverbar maintains this stretched position during the movement into the ramming position 4''' (FIGS. 3 and 7).

The leverbar comprises two parallelogram-like links, which are successively connected. The rear parallelogram link is formed by guide rods 29, 30, a base 31 forming the foot of the support 17, and a coupler 32 which, at the same time, forms the connection to the front parallelogram link. The latter, in turn, comprises the guide rods 33, 34 with the coupler 32 as the base and a coupler or thrust piece 35 connecting its other end and which once again forms a pressure or thrust piece of the rammer engaging on the shell bottom. The function of the two parallelogram links is to guide the thrust piece 35 throughout the movement sequence parallel to the bottom of the shell 4. The successively arranged guide rods 29, 33 and 30, 34, in each case, form an articulated lever shown in the stretched position in FIGS. 6 and 7. The guide rods 29, 33 of one articulated lever are connected by a leverbar joint 36 to the coupler 32, which, the guide rods 30, 34, forming the other articulated lever, are directly interconnected by a leverbar joint 37. The joint 37 of one articulated lever is bridged by a joint brace 38, 39, which once again has a joint 40. The coupler 32 is constructed as a guide, in which is guided a joint 40 of the joint brace 38, 39, by, for example, a sliding block. This permits a lateral compensating movement, which ensures that the thrust piece 35 is always guided in the barrel axis. The stretched position of the arms of the articulated lever 29, 33 and 30, 34 is limited by corresponding stops on the facing ends of the guide rods. From the stretched position 17", the leverbar 17 can be laterally collapsed or folded, so as to pass into the recoiled or retracted position 17'. This function is fulfilled by a curved section 41, controlled by the loading tray 13 during the return of the latter together with the support 17. The curved section acts on a roll 42 in the vicinity of the rear end of the leverbar and forces the latter to laterally fold, that is, downwards in the drawing.

The loading tray 13 has its own drive 43, which is, for example, constructed as an electric motor and acts via a spindle 44 on a shoulder 45 with a spindle nut on the base 22. By the drive 43, the loading tray 13 and the inserted shell 4 is moved out of the starting position 4', where the support 17 is in the collapsed or retracted position 17' (FIG. 5), into the support position 4". During this movement, the leverbar is carried along by drivers (not shown) on the loading tray, is then raised and brought into the stretched position 17" (FIG. 6).

A motor biased tension spring 46, which acts on the support by a multimember gear serves as the drive 21 for the ramming movement of the support. The tension spring 46 is relaxed in the starting position (FIG. 5). The spring 46 extends between two abutments 47, 48, with the front abutment 48 being displaceable for enabling a tensioning of the tension spring 46. For this purpose, a motor 49 is provided which, by a chain 50 or the like, drives a spindle 51 traversing the tension spring 46 and which, in turn, drives the abutment 48 and pretensions or biases the tension spring 46 in the support position (FIG. 6). A gear 52 and a chain drive 53 are located between the spring 46 and the support 17. The gear 52 has a rack 54, which at its one end forms the abutment 47 and which also travels the entire spring deflection. The rack 54 meshes with a fixed pinion 55 on whose spindle is located a pulley 56 which, in turn, meshes with the teeth on a chain wheel 57. The pinion 55, pulley 56 and chain wheel 57 are jointly mounted on a bearing block. The driving chain wheel 57 of the chain drive 53 includes two further fixed guide wheels 59, 60. In addition, a chain wheel 61, 62 is mounted on the front end and the rear end of the loading tray 13. The chain 63 is connected at both ends to the support 17 or the leverbar forming the latter, namely, on the guide slide 26 in the vicinity of the base 31 at a fixed point 64, and, at the front end of the guide slot 26, at a fixed point 65. Thus, from a fixed point 65, the chain 63 is guided over the front chain wheel 62, the rear chain wheels 61 of the loading tray 13 and then, in a double loop, over the driving chain wheel 57 on the bearing block 58 and, finally, via the fixed guide wheels 59, 60, to the rear fixed point 64. The gearing of the spring deflection or the path of the rack 54, via the pinion 55, and the larger diameter pulley 56 is, preferably, 1:3.5. It is pointed out at this point that the chain wheels 61 are shown rearwardly displaced at the rear end of the loading tray (FIG. 5), so as to make the other parts visible. The actual position is shown in FIGS. 6 and 7.

The support 17 or its guide slide 26 is held by a release mechanism 66 with catches 67, which only release the guide slide 26 when the support position 4" or the stretched position 17" (FIG. 7) is reached. The release mechanism 66 can be controlled by, for example, an electromagnet 68 or the like.

The propellant charge chamber 18 of the barrel 2 is provided, upstream of the breech block 5 (FIGS. 1 and 2) at its rear end, with a bottom ring 69 which, at least in the vicinity of the lower tip projects into three cross-sections of the chamber 18 and serves as a rear support for the inserted propellant charge. For the shell 4 and, in particular, the shell ring 20, the bottom ring forms a "trip edge", which presents a problem in a correct ramming of the shell. Thus, on moving out of the starting position 4' shown in FIGS. 2 and 5, into the support position 4'', shown in FIGS. 3 and 6, the loading tray 13 is moved up to the bottom ring 69 in such a manner that the tray has a flush transition at the ring 69. For this purpose, the leading end of the loading tray is provided with a resilient centering projection 70, which runs into a guide bore 71 on the bottom ring 69.

The ramming process will now be described. In the starting position 4' according to FIG. 5 in which the shell 4, located in the loading tray 13', is aligned with the barrel bore axis, the leverbar, forming the support 17, is in the collapsed position 17' and is held by the catch 67 of the release mechanism 66. The tension spring 46 is relaxed, with the rack 54 assuming its rear position (furthest right in the drawing). The loading tray is moved by the drive 43, via the spindle 44 from the starting position 4' into the support position 4''. Synchronously therewith, the tension spring 46 is pretensioned by the drive 49, via the chain 50 and spindle 51. By a driver (not shown), the loading tray 13 entrains the leverbar coupler 35 forming the thrust piece, so that it is raised and passes into the stretched position 17''. The leverbar is still restrained by the catch 67. The loading tray is located in the bottom piece of the barrel 2 in the support position 4'', so that the shell already projects into the barrel. The loading tray 13 is centered in the support position on the bottom ring 69 of the propellant charge chamber 18 by the centering projection 70 engaging in the guide bore 71.

In the support position 4'' (FIG. 6), the release mechanism or its catch 67 releases the guide slide 26 of the now stretched support, so that the tension spring 46 can relaxed and carries with it the rack 54 via the rear abutment 47. The rack drives the pinion 55 with the pulley 56, whose torque is transferred to the chain wheel 57 and, therefore, to the chain 63. The guide slide 26 and, consequently, the stretched support 17 are forwardly accelerated with respect to the loading tray 13 With the thrust piece 35 accelerating the shell over and beyond the bottom ring 69 and freely moving the shell in the barrel into the ramming position 4''', where the shell is rammed by ring 20 into the barrel rifling.

Following the ramming operation, the relaxed spring 46 is moved back by the motor 49, via the front abutment 48, into the starting position according to FIG. 5, accompanied by the entrainment of the rack 54 and the rear abutment 47. The movement of the rack is transferred via the chain drive 53, which now runs in the opposite direction, to the support 17. During the return movement of the support 17, the loading tray 13 is also moved by its drive 43 into the starting position. Towards the end of the return movement of the support 17, a force is exerted in the roll 42 on the guide rod 29 by the curved section 41 controlled by the loading tray 13 and, as a result, the leverbar is forced into its collapsed position (at the bottom in the drawing). Prior to this state, the guide slide 26 has already runned into the catch 67 of the release mechanism 66m, so that finally the starting position according to FIG. 5 is reached.

It is also pointed out that the stability of the support for accelerating the shell is optimized by slightly overtravelling a dead center position of the leverbar joints 36, 37. This overtravelling of the dead center position can be assisted by a correspondingly stretched spring. A spring 70' is provided for cushioning engagement between the center projection 70 and the depression 71.

We claim:

1. Apparatus for loading a tubular weapon with a propellant charge chamber, the apparatus comprising a loading arm pivotably mounted on a pilot bearing of a barrel of the weapon, a loading tray for a shell, a ramer engaging a bottom of the shell, and a drive for said rammer, said shell being brought into a starting position aligned with the barrel bore axis by said loading arm and said loading tray and transported by the rammer into the barrel and rammed into a rifling of the barrel, wherein the loading tray is movable in a guide on the loading arm between the starting position and a support position with the shell being centered with respect to the barrel bore axis, the rammer includes a support engaging on the bottom of the shell which is retracted in eh starting position, whereby said support can be brought into a stretched position synchronously with the movement of the loading tray into the support position and, in the stretched position can be displaced in a guide by the drive relative to the loading tray while the loading tray is in said support position, said displacement being accompanied by an acceleration of the shell into the barrel, and wherein driving mean sis connected to the support to the loading tray so as to enable the support tray to be raised into the stretched position by a movement of the loading tray.

2. Apparatus according t claim 1, wherein the drive includes at least one motor-biased spring, a gear with transmission for transforming a deflection of the spring into a rotary movement, and a chain drive coupled to the gear and acting on the support when the support is in the stretched position.

3. Apparatus according to claim 2, wherein the chain drive comprises a chain wheel and wherein the chain drive is guided by the driving chain wheel, a pair of additional chain wheels are arranged at opposite ends of the loading tray to one side of the support and at least one further chain wheel is provided on the loading arm and cooperate with the chain drive.

4. Apparatus according to claim 2, wherein the gear with transmission comprises a rack, a filed pinion meshing therewith, and a pulley, located on a spindle of the pinion, for driving a chain wheel of the chain drive.

5. Apparatus according to one of claims 2 or 4, wherein the deflection of the spring is at least 1:2.

6. Apparatus according to claim 4, wherein the pinion and the pulley cause the deflection of the spring.

7. Apparatus according to claim 4, wherein the rack is connected to one end of the spring, the pinion is fixedly mounted on the loading arm, and the drive tensioning the spring engages on an opposite end of said spring.

8. Apparatus according to claim 4, wherein the chain drive is guided by the driving chain wheel, a pair of additional chain wheels are arranged at opposite ends of the loading tray to one side of the support and at least one further chain wheel is provided on the loading arm and cooperates with the chain drive.

9. Apparatus according to claim 4, wherein the support includes a leverbar adapted to be brought from a flat, collapsed position in the starting position into a stable stretched position in the support position.

10. Apparatus according to claim 9, wherein the leverbar comprises two successively connected parallelogram links, guide rods for respectively forming articulated levers articulated at one end on a base forming a foot of the support and at an opposite end on a coupler forming a thrust piece and engaging on at the bottom of the shell, and wherein an articulated joint of one of said articulated levers is bridged by a joint brace including a joint cooperable with a guide extending between the articulated levers and on which another joint of another articulated lever is located.

11. Apparatus according to claim 9 further comprising a stop mechanism associated with the leverbar for deflecting the leverbar on recoil.

12. Apparatus according to claim 11, wherein the motor-biased spring, when the spring is relaxed entrains the rack and by the gear entrains the chain drive, whereby the support is returned from a ramming position, through the support position into the starting position and, upon reaching the starting position the loading tray acts on the stop mechanism to initiate a folding movement of the leverbar.

13. Apparatus according to one of claims 1, 2 or 4, wherein the driving means returns the loading array from the support position into the starting position.

14. Apparatus for loading a tubular weapon with a propellant charge chamber, the apparatus comprising a loading arm pivotably mounted on a pivot bearing of a barrel of the weapon, a loading tray for a shell, a rammer engaging a bottom of the shell, a drive for said rammer, said shell being brought into a starting position aligned with the barrel bore axis by said loading arm and said loading tray and transported by the rammer into the barrel and rammed into a rifling of the barrel, wherein the loading tray is movable in a guide on the loading arm between the starting position and a support position with the shell being centered with respect to the barrel bore axis, the rammer includes a support engaging on the bottom of the shell which is retracted in the starting position, whereby said support can be brought into a stretched position synchronously with the movement of the loading tray into the support position, and, in the stretched position, can be displaced in a guide by the drive relative to the loading tray while the loading tray is in said support position, said displacement being accompanied by an acceleration of the shell into the barrel, and wherein the drive of the rammer includes at least one motor-biased spring, a gear with the transmission for transforming a deflection of the spring into a rotary movement, and a chain drive coupled to the gear and acting on the support when the support is in the stretched position.

* * * * *